US010222162B2

(12) United States Patent
Adamson, Jr.

(10) Patent No.: US 10,222,162 B2
(45) Date of Patent: Mar. 5, 2019

(54) FIREARM SOUND SUPPRESSOR

(71) Applicant: APD Manufacturing, LLC, Nampa, ID (US)

(72) Inventor: David K. Adamson, Jr., Nampa, ID (US)

(73) Assignee: APD Manufacturing, LLC, Nampa, ID (US)

( * ) Notice: Subject to any disclaimer, the term of this patent is extended or adjusted under 35 U.S.C. 154(b) by 0 days.

(21) Appl. No.: 15/483,569

(22) Filed: Apr. 10, 2017

(65) Prior Publication Data

US 2017/0299313 A1 Oct. 19, 2017

Related U.S. Application Data

(60) Provisional application No. 62/321,825, filed on Apr. 13, 2016.

(51) Int. Cl.
*F41A 21/30* (2006.01)

(52) U.S. Cl.
CPC ..... *F41A 21/30* (2013.01)

(58) Field of Classification Search
CPC ..... F41A 21/28; F41A 21/30; F41A 21/32; F41A 21/325; F41A 21/34; F41A 21/36; F41A 21/38
USPC ..... 89/14.2–14.4; 181/223
See application file for complete search history.

(56) References Cited

U.S. PATENT DOCUMENTS 7,874,238 B2 1/2011 Silvers
8,162,100 B2 4/2012 Shults et al.
9,366,495 B1 * 6/2016 Coppinger ..... F41A 21/30
2010/0126334 A1 5/2010 Shults et al.
2012/0103176 A1 * 5/2012 Latka ..... F41A 21/30 89/14.4
2012/0291614 A1 * 11/2012 Koumbis ..... F41A 21/30 89/14.4
2016/0018177 A1 * 1/2016 Powell ..... F41A 21/30 89/14.4
2016/0187093 A1 * 6/2016 Barrett ..... F41A 21/30 89/14.4

OTHER PUBLICATIONS

MC Hale, Tom, AMTAC Suppressor Shortens the Rifle Silencer Market, Tactical Retailer, Apr. 2017, pp. 26-28.
Gaspar, Steve, Shot Show Suppressor Roundup: New Silencers for the New Year, Shooting Sports Retailer, Apr. 2017, pp. 26-28.

* cited by examiner

*Primary Examiner* — John Cooper
(74) *Attorney, Agent, or Firm* — Warner Norcross + Judd, LLP

(57) ABSTRACT

A suppressor for reducing muzzle blast and noise of firearms. The suppressor can include a baffle tube including a stack of baffle modules that are removably coupled to one another, and an optional blast baffle, end cap and end cap insert. The stack can be independently supported from both bullet entry and exit ends of the tube, with the stack under tension and the tube under compression. Two or more tubes of can be joined with one another at ends having corresponding sealing flanges, which also can center the tubes relative to one another. A blast baffle can separate pressurized gas into a first pathway through the baffle stack and a second pathway between the baffle modules and the baffle tube. The baffle tube and/or an expansion chamber tube can include a rearward end cap that is removable and replaceable with an over the barrel expansion tube.

10 Claims, 9 Drawing Sheets

FIREARM SOUND SUPPRESSOR

BACKGROUND OF THE INVENTION

The present invention relates to sound suppressors and silencers for firearms, and more particularly to a suppressor having a modular system of baffles, a blast tube and an expansion tube removably and detachably joined with one another to facilitate customization and repair of components of the suppressor.

Firearm suppressors, also known as silencers, reduce the audible noise or sharp report of a firearm by controlling and reducing the energy levels of propellant gases discharged from the muzzle of the firearm. Most conventional suppressors include a tube or "can" having a series of baffles therein that control and delay the flow, expansion, and exit of propellant gases from the silencer. In so doing, the silencers achieve a corresponding reduction in the noise produced by the exiting propellant gases.

Many conventional suppressors include baffles and internal components that are fixedly welded to the silencer can and/or one another. Over time, the baffles and components can become dirty from the gases and debris carried in them. Because the components are fixed, they can be difficult to clean. Further, if a silencer is misaligned with a muzzle, a bullet can damage one of the baffles or other internal components. Due to the fixed connections, it can be difficult if not impossible to replace the damaged component and repair the suppressor.

Some suppressors include cans that are welded or joined with threads to end caps or other tubes. Where welded, the cans can be difficult to replace or change out when damaged due to a misaligned bullet or external impacts to the can. Where solely threaded together, the threads sometimes might not offer a perfect seal to prevent propellant gases from escaping therethrough. This can result in the discharge of hot propellant gases and associated debris where the components are joined.

In operation, as mentioned above, most silencers include baffles inside the can that control the flow, expansion and exit of propellant gases from the silencer. These baffles generally direct the flow of gases from the muzzle along a single pathway toward the exit of the can. Along the way, the baffles can dissipate and redirect the gases, but generally the single gas pathway leads through bullet apertures defined at an interior of the baffles or center of the can. While effective in many cases, the single gas pathway might present issues in effectively dissipating the gases and controlling expansion.

Some silencers are outfitted with an over the barrel expansion chamber which is basically an extension of the can that extends rearward of the muzzle, over a portion of the barrel to which the silencer is joined. While this can offer more area within the can to control and dissipate expanding gases, it can present issues when a user utilizes the silencer with different weapons. For example, the silencer and in particular the over the barrel expansion chamber may readily fit over a standard government profile barrel, however, when the user tries to put the silencer on a firearm with a bull barrel or odd front handguard, the over the barrel expansion chamber might not fit. This can limit the versatility of the silencer and its compatibility with different weapon systems.

Accordingly, there remains room for improvement in the field of silencers and suppressors for firearms.

SUMMARY OF THE INVENTION

A suppressor for reducing muzzle blast and noise of firearms is provided.

In one embodiment, the suppressor can include a baffle tube including a stack of baffle modules that are removably coupled to one another, independently supported from both bullet entry and exit ends of the tube, with the stack under tension and the tube under compression. With this support, the baffle modules can be adequately supported and aligned properly with one another and the baffle tube.

In another embodiment, the baffle stack can include a blast baffle that separates pressurized gas into a first pathway through the baffle stack and a second pathway between the exteriors of the baffle modules and the inside wall or surface of the baffle tube. Optionally, the second pathway can be a helical pathway defined between an interior surface of the blast tube and an exterior of the blast module. In some cases the helical pathway can be defined along the exterior of a module and/or an interior surface of the baffle tube. The second pathway can be distal from the first gas pathway, with the pathways can be separated by walls or portions of the baffle modules. Thus, the expanding propellant gas can be dissipated along different routes through the tube.

In still another embodiment, the suppressor can include two or more tubes joined with one another at ends having corresponding tapered flanges, optionally to seal and center the tubes relative to one another. For example, the baffle tube can include a first tapered sealing flange. The expansion chamber tube can include a second tapered sealing flange, with each including surfaces that correspond to and/or mirror one another. When the flanges are engaged under a compressive force pushing the surfaces into engagement with one another, optionally via a compression nut, the flanges produce a sealed joint between the tubes. Due to the taper of the surface, the tubes also achieve concentricity with one another so the interior surfaces and exterior surfaces of each of the tubes can be flush and/or aligned with one another.

In even another embodiment, the expansion tube can include a front rim and a rear rim. Each rim can include a tapered flange. The front rim can be sealingly engaged with the blast tube, and the rear rim can be sealingly engaged with a rearward end cap.

In a further embodiment, a forward tapered sealing flange of the expansion tube can seal with a rearward tapered sealing flange of the blast tube. These two components can be forced together with a compression nut threaded onto an exterior of the blast tube and/or expansion tube.

In still a further embodiment, the rearward tapered sealing flange of the expansion tube seals with a corresponding tapered sealing flange of the rearward end cap, and the two can be forced together via tightening a threaded portion of the rearward end cap onto a corresponding threaded portion of a muzzle interface of the expansion tube.

In yet another embodiment, the baffle tube and/or an expansion chamber tube can include a rearward end cap that is removable and replaceable with an over the barrel expansion tube. The over the barrel tube can include an inner tube and an outer tube. The inner tube can include a tapered flange that engages and seals against the rearward rim of the expansion tube after the rearward end cap is removed and replaced with the over the barrel expansion tube. The inner tube can include a threaded portion that engages threads of the muzzle interface. The flanges of the outer tube and expansion tube rearward rim can be forced together by tightening the inner tube. The resultant joint is sealed to prevent expanding, pressurized gases from escaping.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
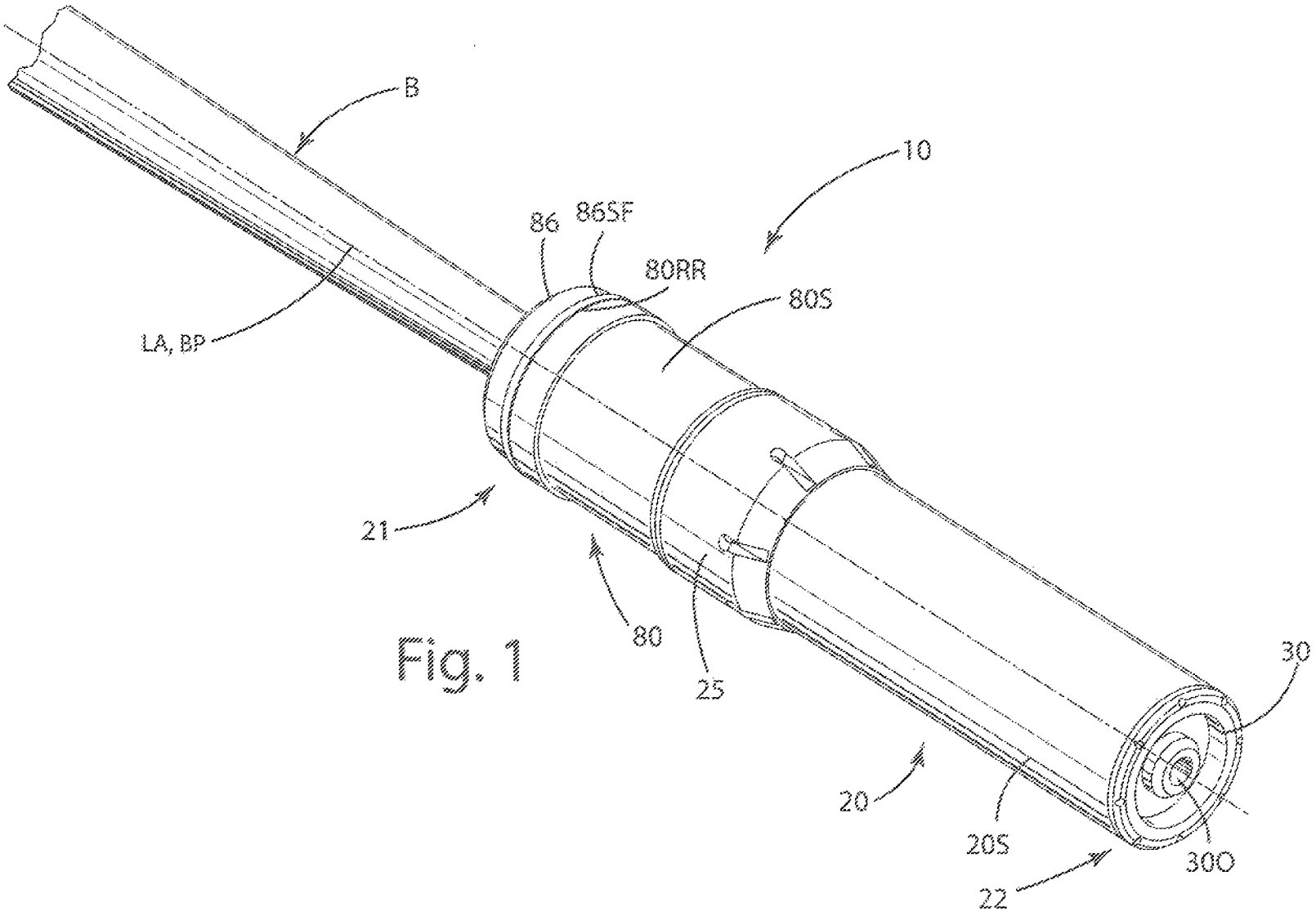
FIG. 1 is a perspective view of the suppressor of a current embodiment.
Figure 2:
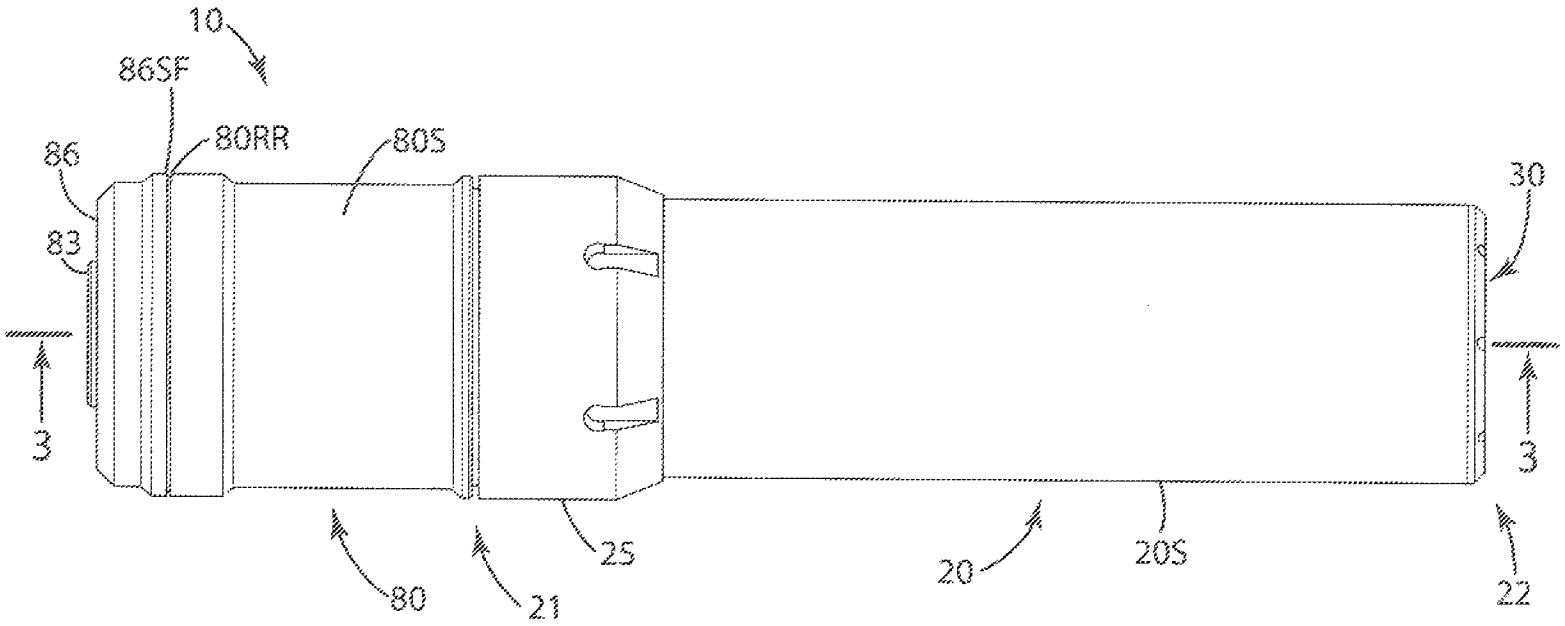
FIG. 2 is a right side view of the suppressor, the left side view being a mirror image thereof.

A current embodiment of the suppressor is illustrated in FIGS. 1-12, and generally designated 10. The suppressor 10, also referred to as a silencer herein, can include an elongate baffle tube 20 that can house a front end cap insert 30 and a front end cap 40, along with one or more baffle modules 50, 60 and a blast baffle 70. The baffle tube 20 can be joined with an expansion chamber tube 80 configured to lower the pressure and temperature of the discharged propellant gases, from the firearm muzzle or muzzle break to which it is attached, to a level beneficial to the function of the components in the remaining paths through the silencer. As described later in connection with FIGS. 10-12, the suppressor 10 can include an optional over the barrel expansion tube or chamber 90, which is by its namesake, configured to extend rearward over a portion of the barrel B of the firearm to which the suppressor 10 is joined. This over the barrel expansion tube 90, however, can be removable from the expansion chamber 80 and replaceable with a rearward end cap 86, so the suppressor can be selectively used with or without the over the barrel tube 90.

Generally, the foregoing components of the suppressor 10 reduce the energy of propellant gases, thus achieving a corresponding reduction of associated firing noise and signature. The internal components of the suppressor contain, delay, deflect, control, and/or disperse gases associated with a bullet exiting the barrel B of the firearm.

The components of the suppressor 10 can be manufactured from a variety of materials, alone or in combination, including but not limited to titanium, aluminum, steel, alloys, resins, polymers, composites, carbon fiber, heat dissipating materials, carbon fiber reinforced ceramics or other heat-conducting, heat-resistant material, and any like materials. Notably, the projectile referred to herein is frequently described as a "bullet" for illustrative purposes, but any suitable projectile may be used in connection with the suppressor. Further, the suppressor can be joined with any suitable firearm, or other projectile shooting device, regardless of whether it technically is considered a firearm. Any such firearm or projectile shooting device is generally referred to herein as a "firearm."

Turning now to FIGS. 1-6, the suppressor and its components will now be described in more detail. To begin the suppressor includes the elongate baffle tube 20. This baffle tube 20 includes a bullet entry end 21, an opposing bullet exit end 22 and a longitudinal axis LA. The baffle tube can delineate or house a bullet pathway BP extending longitudinally therethrough from the bullet entry end to the bullet exit end. This bullet pathway BP can be aligned with and can follow the longitudinal axis LA. Optionally, the respective bullet entry end 21 and opposing bullet exit end 22 can be joined with respective other components of the suppressor 10.

Further optionally, the bullet openings at the respective ends need not be perfectly sized to accommodate a particular caliber bullet. Instead, the forward or front end cap and/or forward end cap insert, rearward end cap and/or expansion chamber tube can be sized to have bullet passageways or openings that correspond to one or more calibers for which the suppressor is designed. More particularly, the front end cap insert 30 and/or front end cap 40, as well as the rear of the expansion chamber tube 80 can define respective bullet openings 30O, 40O and 80O sized for a particular caliber bullet which for which the suppressor is designed. Of course, as described further below, the expansion chamber tube 80 can include an over the muzzle interface 83 which joins to a muzzle break or muzzle of a firearm.

The baffle tube 20 can further include a sidewall 20S having an interior and an exterior, so that the blast baffle tube forms a tubular casing or enclosure. As used herein, the term "tubular" refers to an elongate structure with an outer sidewall 20S and a hollow interior 201, wherein the cross-sectional shape of the structure may be any closed shaped, such as a curved shape, for example, a circle, ellipse, oval, or the like, or a polygonal shape, for example, a triangle, rectangle, square, pentagon, hexagon or the like.

The elongate baffle tube 20 can be constructed to include a front or forward rim 20FR disposed at the forward portion of the sidewall 20S. This front rim 20FR optionally can circumscribe and/or surround all or part of the opening defined at the bullet exit end 22 of the suppressor. The forward rim 20FR can be of the same thickness as the sidewall 20S. Rearward of the forward rim 20FR, however, the sidewall 20S can define front threads 20FT. These threads can be configured to threadably couple components of the baffle stack 50BS, having corresponding threads, to the elongate baffle tube 20 as described in further detail below. Generally, the threads can circumscribe and/or surround all or part of the opening defined at the bullet exit end 22 of the suppressor and/or all or part of the forward end cap 40 and insert 30.

The baffle tube 20 can include a rear rim 20RR distal from the front rim 20FR and generally disposed adjacent the bullet entry opening 21. The sidewall 20S can extend between the forward rim and the rearward rim. The rear rim 20RR can circumscribe and/or surround all or part of the opening defined at the bullet entry end 21 of the baffle tube 20. The rear rim 20RR can include and/or be formed as a support rim 23. This support rim 23 can be configured to support and/or engage the blast baffle 70 and/or a portion of the expansion chamber tube 80. For example, the support rim 23 can include a lip 23L that can be disposed around the opening of the bullet entry end of the baffle tube 20. This lip can engage a ring of the blast baffle 70 as described further below.

The bullet entry end 21 of the baffle tube 20 also can include an elongate baffle tube tapered flange 24 adjacent and/or forming part of the support rim 23. This tapered flange can be a frustoconical shaped flange that flares outwardly when extending toward the bullet exit end 22 of the baffle tube 20. More particularly, the flange can flare out at an angle relative to the sidewall 20S of the tube 20. Alternatively, the flange can flare out in a curved manner relative to the sidewall 20S of the tube 20. The flange can be annular and can circumscribe all or part of the opening of the bullet entry end 21 of the tube 20.

Optionally, the tapered flange 24 can be structured and shaped so that it can engage a corresponding tapered flange 84 of the expansion chamber tube 80, and optionally form a sealing engagement between the baffle tube 20 and the expansion chamber tube 80 at the corresponding joint. By sealing engagement it is meant that the flanges surfaces engage one another and substantially prevent propellant gases from being discharged at the join points of engagement around the respective flanges. The expansion chamber tapered flange 84 can be flared inward toward an interior 801 of the expansion chamber tube 80. Optionally, the expansion chamber tapered flange 84 can form a frustoconical recess or region around the forward rim 80FR of the expansion chamber tube 80. This frustoconical recess can receive a like shaped frustoconical tapered flange 24 of the elongate baffle tube 20, allowing the flanges to seat in sealing engagement against one another. Given the interface of these flanges 24 and 84 and their shapes, the baffle tube 20 can be forced into concentricity and alignment with the expansion chamber tube 80, in which case, the interior and exterior surfaces of these tubes can be aligned and parallel with, but in some cases, slightly offset from one another.

Optionally, the blast tube 20 and expansion tube 80 can be secured to one another with a compression nut 25, also referred to as a jam nut herein. The jam nut can include a threaded portion 25T that threadably couples the compression nut 25 to the corresponding expansion chamber tube 80, optionally via corresponding threads 85T associated with an exterior of the expansion chamber tube 80. When the compression nut 25 is tightened, an internal shoulder 25S of the nut engages the tapered flange 24 along a ledge 24L. Upon engagement of the shoulder 25S with the ledge 24L, and subsequent tightening of the compression nut, the expansion chamber tube 80 is drawn toward the elongate baffle tube 20. This in turn forces the tapered flanges 24, 84 against one another so that they effectively form one or more sealed surfaces around the joined ends of the tubes. This in turn can form a sealed joint at their interface, which can contain the gases inside the expansion tube and blast tube. Due to the taper, this force exerted by the compression nut also forces the above-mentioned concentricity and general alignment of the two tubes relative to one another. Optionally, the configurations of the flanges 24 and 84 can be reversed, so that these are on the opposite structures than as shown. Further optionally, the location of the threads can be modified, for example, the threads can be included on the baffle tube 20 so that the compression nut 25 can be oriented in a reverse manner to secure the expansion tube 80 to the elongate baffle tube 20. Even further optionally, the tapered flanges used to seal the tubes at a joint can be replaced with other structures. For example, the flanges can be substituted with gaskets, high temperature o-rings and respective grooves in the respective rims to hold the gaskets and/or o-rings.

As illustrated, the expansion chamber tube 80 can be joined with but removable from the elongate baffle tube 20 with the use of tools and/or manually, and without the destruction of either of the tubes. In this manner, the different components, in particular the tubes can be replaced and/or repaired relative to one another. Alternatively, the expansion chamber tube 80 can be integrally formed as a single piece unit with the elongate baffle tube 20, in which case it may still be considered to be joined with the baffle tube 20.

Figure 3:
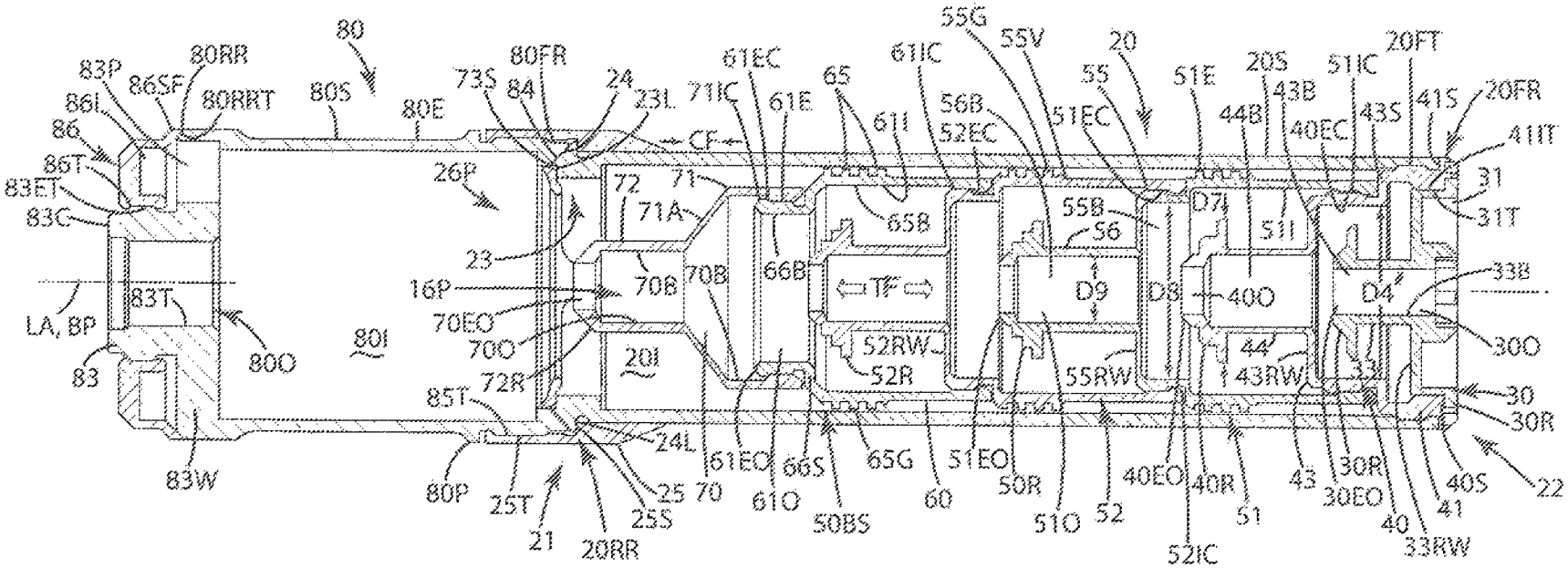
FIG. 3 is a section view of the suppressor taken along lines 3-3 of FIG. 2.
Figure 4:
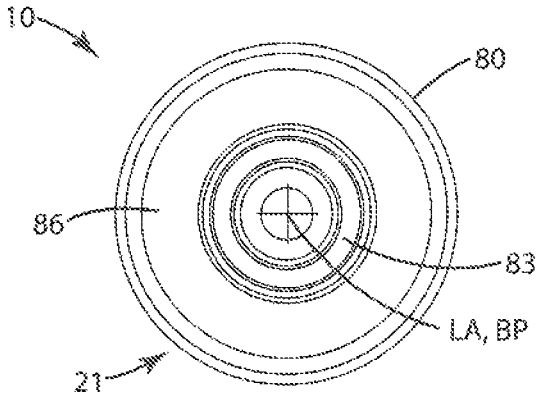
FIG. 4 is a front view of the suppressor.
Figure 5:
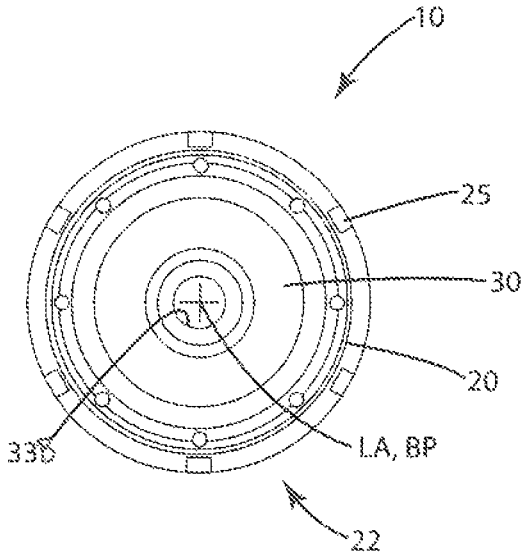
FIG. 5 is a rear view of the suppressor.
Figure 6:
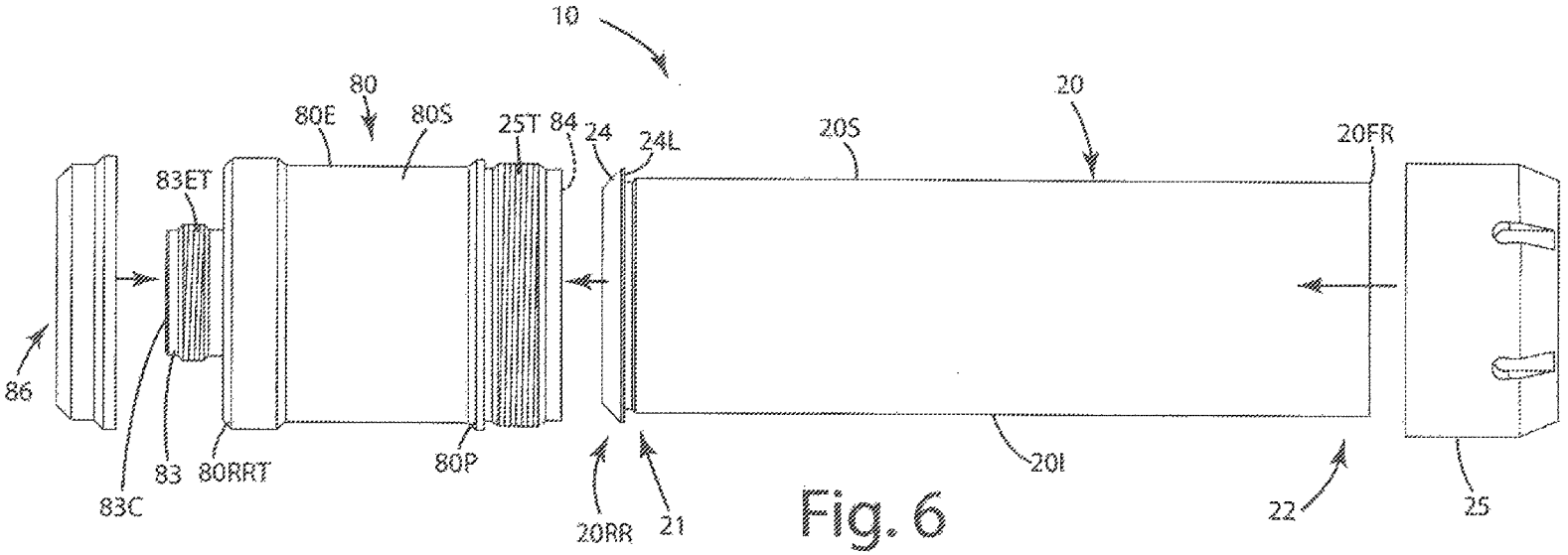
FIG. 6 is an exploded view of an expansion chamber tube and a baffle tube of the suppressor, along with a compression nut and rearward end cap.

Referring now to FIGS. 3 and 4, the expansion tube 80, as explained above, is secured to the baffle tube 20. The expansion tube 80 can define an internal chamber 801. It is this internal chamber that forms the expansion chamber of the suppressor for receiving pressurized propellant gases as they are expelled from a barrel to which the suppressor is attached. This large internal chamber helps dissipate the gases and reduce temperatures of the suppressor caused by the expulsion of those gases therein. While a blast baffle or baffle modules can be disposed in the baffle tube, optionally no blast baffle or baffle module is disposed in the expansion chamber tube 80, in which case the expansion tube includes no part of the baffle stack 50BS. Further, the internal cavity 801 optionally can be void of any internal components between the muzzle interface 83 and the tapered flange 84 or lip.

The expansion chamber tube 80 can extend from the front rim 80FR to the rear rim 80RR, with a sidewall 80S extending therebetween. This sidewall can include one or more annular protrusions on the exterior 80E of the tube. One protrusion 80P can form a seat against which the compression nut 25 can be tightened when securing the expansion chamber tube to the elongate baffle tube 20.

As shown in FIG. 3, the expansion chamber tube 80 can be joined with a muzzle interface 83. This muzzle interface can include threads 83T configured to threadably engage and join with threads on a firearm barrel or a muzzle break joined with the barrel, depending on the application. In turn, this can secure the expansion tube and thus the remainder of the suppressor 10 to the firearm, in particular the muzzle of the barrel. The muzzle interface 83 can project rearwardly beyond the rear rim 80RR of the expansion chamber tube. The interface 83 can include a central portion 83C to which one or more webs 83W are secured. These webs can define one or more backflow ports 83P through which propellant gases can be dissipated rearward and over at least a portion of the central portion 83C of the interface 83. Optionally, when dissipated rearward, the gases can engage and enter an internal annular cavity 861 of the rearward end cap 86, or when the over the barrel expansion chamber 90 is replaced for the end cap 86, the gases can enter and engage the internal cavity 901 thereof.

As illustrated in FIG. 3, the suppressor 10 is set up with a rearward end cap 86. This rearward end cap 86 is joined with the expansion chamber tube 80. In particular, the rearward end 86 can include threads 86T that threadably engage exterior threads 83ET on the exterior of the central portion 83C of the muzzle interface 83. The rearward end cap 86 also can include a forward flange 86SF that is configured to engage the rearward rim 80RR of the expansion chamber tube 80. In particular, this flange 86SF can be tapered, similar to the taper of the flange 84 at the front of the expansion chamber tube 80. Generally, the flange 86SF can form a frustoconical annular ring or recess about an outer perimeter or circumference of the rearward end cap 86. The rear rim 80RR can include a taper 80RRT as well. This taper 80RRT can correspond to the taper of the flange 86SF. When the rearward end cap 86 is tightened onto the central portion 83C of the interface 83, the tapered flange 86SF of the rearward end cap 86 engages the rearward rim 80RR and taper 80RRT of the expansion chamber tube 80. Accordingly, these two components can be brought into sealing engagement with one another and forcibly engaged against one another. The sealing also forces concentricity of the rearward end cap 86 relative to the expansion tube 80. Optionally, the rearward end cap 86 can be manufactured to mate directly to the barrel and/or muzzle of the firearm, instead of the interface 83, and can incorporate an attachment mechanism that facilitates rapid attachment or detachment of the expansion tube 80 and/or blast tube 20.

Suppressor 10, as shown in FIGS. 2-7 can include a baffle stack 50BS. This baffle stack 50BS can be disposed substantially entirely in the baffle tube 20. Of course in some cases, where the expansion chamber tube is integral with the elongate tube 20, the baffle stack and its components can extend into the expansion chamber tube as well. Generally speaking, the baffle stack can include at least two baffle modules 51, 52, 60, and a blast baffle 70. The baffle stack 50BS also can include a forward end cap 40 and a forward end cap insert 30. Each of these elements will now be described in detail.

To begin, the forward end cap insert 30 can include a base portion 31. The base portion 31 can include and define a bullet passageway or opening 30O generally centered on the longitudinal axis and/or bullet pathway LA, BP. The base can include external threads 31T. These threads can threadably engage internal threads 41IT of the forward end cap 40, thereby enabling these two components to be joined with one another. The forward end cap insert 30 optionally can be seated on the front rim 20FR of the tube 20. As shown, the end cap insert 30 includes an annular ring 30R that seats against a shoulder 40S of the forward end cap 40. The seating is achieved when the forward end cap insert 30 is sufficiently tightened into the forward end cap 40.

The forward end cap insert 30 can be disposed at the bullet exit end 22 of the blast tube 20, and optionally can be the last element through which the bullet travels as it leaves the suppressor 10. The forward end cap insert 30 can include a first portion 43 that extends rearward from the base 31. In particular, the base can include a rearward wall 33RW. The first portion 43 can extend rearward from this wall. The first portion 33 can define a forward end cap insert first portion bore 33B. This bore can be in spatial communication with the opening 30O extending through the forward end cap insert. The first portion optionally can be cylindrical in shape, as can be the base 31. Optionally, the base can be of a larger diameter than the diameter of the first portion when in a cylindrical shape. Of course, where different shapes are utilized for these components, the dimensions can vary accordingly.

The forward end cap insert 30 can include a bullet entry opening 30EO. This is the opening through which the bullet initially traverses into the first portion 43. In this region, adjacent the bullet entry opening 30EO of the end cap insert, the first portion 43 can include a blast diffusion flange 30R, which can include a plurality of optional cast, molded, raised, or machined steps or ridges. These steps or ridges can add surface area and/or direct, focus, diffuse, and/or impede propellant gas flow as it approaches the bullet entry opening 30EO. Generally, the diffusion flange 30R can diffuse gases outward away from the longitudinal axis LA and into a front end baffle expansion chamber 40EC as described in further detail below. After the gases pass the widest portion of the ridges or steps of the diffusion flange, they become at least partially trapped between the base 31, its rearward wall 33RW, the flange 30R and the interior of the portion 43 to dissipate energy of those gases.

Figure 7:
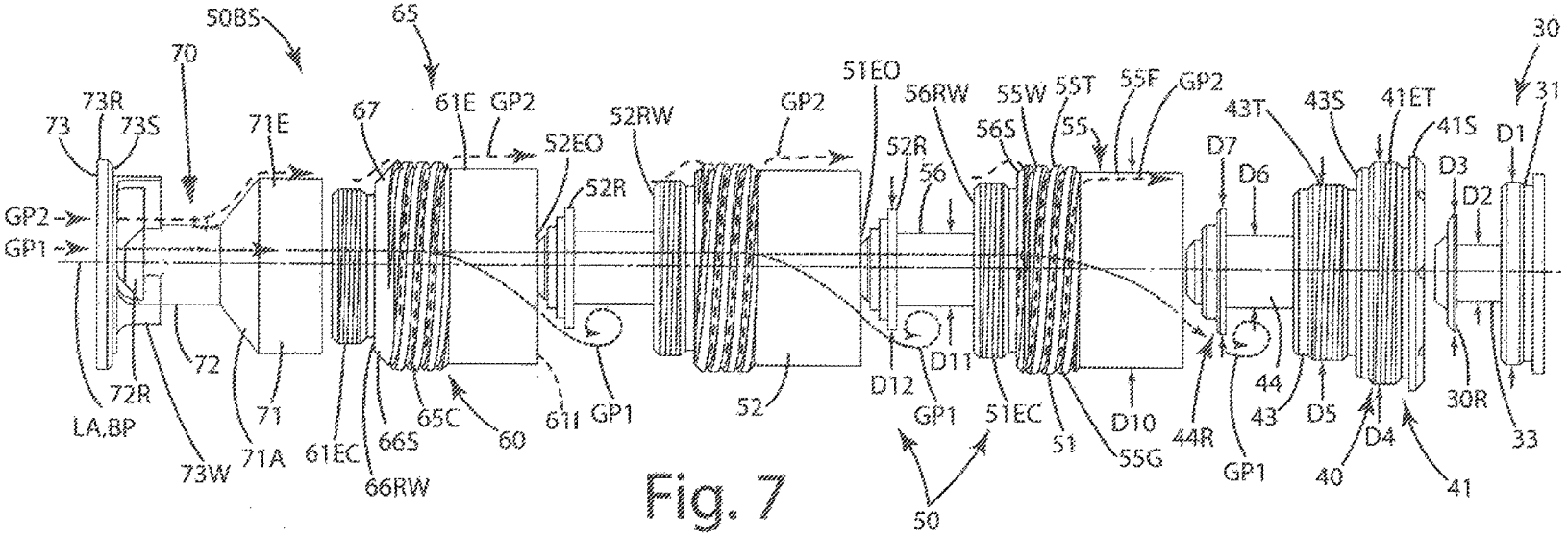
FIG. 7 is an exploded view of a blast baffle, baffle modules, an end cap and an end cap insert of the suppressor.

Optionally, as shown in FIG. 7, the forward end cap insert 30 can be constructed so that the base 31 includes a first diameter D1 and the first portion 33 includes a second diameter D2, while the flange and its optional ridges and/or steps are constructed to include a third diameter D3. The first diameter D1 can be greater than the second diameter D2 and the third diameter D3. The diameter D2 of the first portion 33 can be less than the diameter D3 of the diffusion flange 30R. In some applications, the respective bores inside the first portion and base can have correspondingly sized dimensions. Further optionally, in some cases, the flange 30R can be eliminated from the construction, with the first portion being a cylindrical element terminating adjacent the entry opening 30EO. Alternatively, other types of projections, protuberances, scallops, bumps or the like can be disposed on the first portion to diffuse gas like the diffusion flange.

The forward end cap insert 30, as mentioned above can be threadably coupled to the forward end cap 40. This is so that these two components can be separated from one another with tools or manually, without destroying either of the components. The forward end 40 can include a base 41. This base can include internal threads 41IT that mate with the forward end cap insert threads 31T to secure these components to one another. The base 41 also can include external threads 41ET. These threads can threadably engage and correspond to the threads 20FT of the baffle tube 20, thereby securing the forward end cap 40 to the baffle tube 20, optionally with the tube under compression and the cap and other baffle stack 50BS components under tension, respectively as described below. The base 41 can include a shoulder 41S that is configured to engage against the front rim 20FR of the tube 20 when the forward end cap 40 is sufficiently tightened relative to the other components of the baffle stack 50BS.

The forward end cap 40 can include a second portion 43 extending from the base 41. The second portion 43 can join the base at a shoulder 43S, such that the base 41 is slightly larger than the second portion 43, when measured at the external and internal surfaces thereof. The second portion 43 can include a second portion bore 43B. This second portion 43 can be cylindrical, as can be the base 41. The second portion 43 can include a rearward wall 43RW that transitions to a first portion 44 when extending rearwardly toward the bullet entry end 21 of the elongate tube 20. The first portion 44 can include a first portion bore 44B. This first portion bore 44B can transition to a bullet entry opening 40EO. The second portion bore 43B can be of a diameter D4 that is greater than the diameter D3 of the diffusion flange 30R noted above. This is so that the flange 30R of the forward end cap insert 30 can fit within and be disposed within the second portion bore 43B, with the flange 30R spaced inwardly from the second portion 43 to allow gases to diffuse beyond the flange 30R.

Optionally, the base 41, second portion 43, first portion 44 and flange 40R, when of a cylindrical shape, can be of varying diameters. For example, the base 41 can be of a first diameter D4, the second portion 43 can be of a second diameter D5, the first portion 44 can be of a diameter D6 and the flange 40R can be of a maximum flange diameter D7. The diameter D7 can be larger than the diameter D6, yet smaller than the diameters D5 and/or D4 where included.

Referring to FIGS. 3 and 7, the baffle stack 50BS, as mentioned above, also can include one or more baffle modules 50, 60. These baffle modules can be slightly different from one another. For example, the baffle modules 50, in particular the first baffle module 51 and the second baffle module 52, as shown in FIG. 7, can be substantially identical. Optionally, the baffle modules 51, 52 can be duplicated in number depending on the particular application. For example, in some applications additional noise suppression may be desired. In this case, the baffle tube 20 can be lengthened and additional baffle modules 50 can be secured to the illustrated baffle modules 51 and 52. In some cases one, two, three, four, five or more additional baffle modules can be utilized depending on the application. In other applications, where less noise suppression is acceptable, one of the baffle modules 51 or 52 can be eliminated.

The baffle modules 51, 52 can be substantially identical, so only the first baffle module 51 will be described here. In particular, the first baffle module 51 is sized so that its exterior dimensions enable the first baffle module 51 to be disposed inside the elongate tube 20 between the bullet entry end 21 and the bullet exit end 22. The first baffle module 51 can include an exterior 51E and an interior 511. The exterior 51E can include a threaded exterior connector interface 51EC. The interior can include a threaded interior connector interface 51IC. The threaded interior connector interface 51IC can be configured to engage the threads 43T on the exterior of the forward end cap 40 to threadably join the first baffle module 51 to that end cap 40. The threaded exterior connector interface 51EC can be configured to engage the threads 52IC of the next adjacent or second baffle module 52 to secure those components together.

The baffle module 51 can define a baffle module bullet opening 510 aligned with the bullet pathway, as well as a bullet entry opening 51EO through which the bullet initially enters the baffle module. The first baffle module 51 can include a first baffle module portion 55 that defines a first baffle module bore 55B. This first portion 55 can transition to a second baffle module portion 56 that defines a second baffle module bore 56B. Optionally, the first baffle module bore 55B of a larger internal dimension than the second baffle module bore 56B. Further optionally, the first portion 55 can include a rearward wall 55RW. The second baffle portion 56 can extend from this wall and can be continuous therewith.

As shown in FIGS. 3 and 7, the second portion 56 can include a shoulder 56S. The exterior connector interface 51EC can be disposed adjacent and rearward of this shoulder 56S. In some cases, the next or second baffle module 52 can bottom out against the shoulder 56S upon sufficient tightening of the same. As mentioned above, the second portion 55 can be larger than the first portion 56, particularly along the external surfaces thereof. The second portion 55 can include a second portion bore 55B or chamber. This second portion bore 55B can include one or more internal diameters, depending on the location relative to the shoulder 55S. This second portion 55 can be cylindrical, as can be the first portion 56. The second portion 55 can transition to the first portion 56 when extending rearwardly toward the bullet entry end 21 of the elongate tube 20. For example, the second portion can include a rearward wall 56RW from which the first portion 56 extends rearwardly.

The first portion 56 can include a first portion bore 56B. This first portion bore 56B can transition to a bullet entry opening 51EO. A diffusion flange 40R like that described above, can be disposed adjacent and/or surround the opening 51EO. The second portion bore 55B can be of a diameter D8 that is greater than the diameter D7 of the ridges or steps of the diffusion flange 40R, which as illustrated, is in the form of a stepped cone. This is so that the diffusion flange 40R of the forward end cap 40 can fit within and be disposed within the second portion bore 55B. Thus, the flange 40R can be spaced inward from the second portion 55 and its internal walls to allow gases to pass forward and beyond the flange 40R. Alternatively, the end of the first portion adjacent the bullet entry opening 50EO can be void of the stepped cone or ridged flange, simply terminating at a circular opening there.

Optionally, the second portion 55 forms the interior chamber 511 associated with the second portion bore 55B. In this region, forward of the flange 40R of the forward end cap 40, dissipating and expanding gases can expand and bounce off the walls thereof and the corresponding first portion 44 of the forward end cap 40 disposed in that bore. Again this can enhance the diffusion of gases, thereby reducing the energy levels of the propellant gases within this baffle module.

Further optionally, the second portion 55, first portion 56 and flange 50R can be of varying diameters. For example, the second portion 55 can be of a diameter D10, the first portion can be of an external diameter D11 and the flange 50R can be of a maximum diameter D12. The diameter D12 can be larger than the diameter D11 yet smaller than the diameter D10.

As shown in FIGS. 3 and 7, the baffle module 51 can be outfitted with an outer wall or surface 55W. This outer wall or surface can define a plurality of grooves 55G. These grooves 55G can be helical in structure, or generally forming large threads that coil around the exterior of the first blast baffle 51. When the baffle stack 50BS is placed inside the baffle tube 20, these grooves and the respective threads 55T therebetween are disposed immediately adjacent, and in some cases, contact or otherwise engage the interior surface of the sidewall 20S. These grooves thereby provide a second gas pathway for the gases to travel and thereby reduce energy as described in further detail below. The sidewall 55W also can define a region 55F that is generally flat. This flat region 55F can be disposed adjacent the grooves 55G and threads 55T, without those elements extending into the flat region 55F, except in some alternative applications. In this manner, gases flowing along a second gas pathway GP2 through the grooves, between the baffle module wall 55W and the sidewall 20S of the tube, can exit those grooves 55G, can enter a void or space 55V that is disposed between the interior surface of sidewall 20S and the flat region 55F of the first baffle module 51. It also will be appreciated that the flat region 55F can be flat as it extends along lines parallel to the longitudinal axis LA, but that because the baffle module 51 can be cylindrical, the region 55F is rounded as it extends around the longitudinal axis.

The baffle stack 50BS can be configured so that multiple baffle modules, for example 51, 52 and 60 can be disposed in series and can extend from the bullet entry end 21 to the bullet exit end 22 of the baffle tube 20. Between these ends, the baffle modules, for example 51, 52 and 60, can include one or more sets of grooves, for example, like those helical grooves 55G described above. These grooves, however, can be separated from one another by flat cylindrical portions, for example 55F, of the respective modules so that a gas can travel along a second gas pathway GP2, through grooves of one baffle module, then through another void formed over a flat or cylindrical region of the module, then enter another set of grooves, then over yet another flat or cylindrical region of the next module, then enter yet another set of grooves, to expand over yet another flat region of the next module. In this manner, the second gas pathway GP2 can basically be helical along a first portion, linear through a second portion, helical again through another portion, linear yet again through another portion, helical through another portion, then again linear along another portion of the respective baffle modules, and so on, depending on the number of baffle modules. Again the gases travel along these helical and linear paths, between the exterior surfaces and/or walls of the respective baffle modules and the interior surface of the sidewall 20S of the baffle tube 20. As described below, this second gas pathway GP2 can be separate and distinct from a first gas pathway GP1 that coincides with gases traveling through the respective bullet openings of the modules and other components, generally along the longitudinal axis LA and/or bullet path BP.

As mentioned above, the second baffle module 52 can be threadably joined with the first baffle module 51. The other features of this second baffle module 52 can be substantially identical to that of the first baffle module 51 and therefore will not be repeated again here. Further, as mentioned above, multiple additional identical baffle modules can be added to the suppressor to enhance or change noise attenuation and intensity.

Referring to FIGS. 3 and 7, the suppressor 10 can include a different type of baffle module 60, which can be slightly different from the modules 51 and 52 described above. For example, this baffle module 60 can include an exterior 61E and an interior 611. The exterior 61E can include a threaded exterior connector interface 61EC and the interior can include a threaded interior connector interface 61IC. The threaded interior connector interface 61IC can be configured to engage the threads on the exterior of the second baffle 52 exterior connector interface 52EC, thereby threadably joining the third baffle module 60 to that second baffle module 52. The threaded exterior connector interface 61EC can be configured to engage the threads 71IC of the next adjacent baffle module or a blast baffle 70 as shown.

The baffle module 60 can define a baffle module bullet opening 610 aligned with the bullet pathway, as well as a bullet entry opening 61EO. The baffle module 60 can include a first baffle module portion 65 that defines a first baffle module bore 65B. This first portion 65 can transition to a second baffle module portion 66 that defines a second baffle module bore 66B. Optionally, the first baffle module bore 65B is of a larger internal dimension than the second baffle module bore 66B. Further optionally the second baffle module bore 66B can be larger than the bores 56B and 44B of the other baffle modules and forward end cap insert.

As shown in FIGS. 3 and 7, the second portion 66 can include a shoulder 66S. As mentioned above, the exterior connector interface 61EC can be disposed adjacent this shoulder 66S. In some cases, the next or baffle module or blast baffle 70 as shown can bottom out against the shoulder or the adjacent rearward wall 66RW upon sufficient tightening of the same.

The baffle module 60 optionally can be constructed so that it does not include any type of diffusion flange around the bullet entry opening 61EO. This is so that the baffle module 60 can interface well with the blast baffle 70 as described in further detail below.

The baffle module can include a ramped surface 67 adjacent the shoulder 66S and/or the rearward wall 66RW. This ramped surface 67 can lead into or transition to the helical grooves 65G defined by the exterior 60 of the baffle module 60. This ramped surface 67, which can be annular, also can abut and be adjacent the external surface 71G and the second portion 72 of the blast baffle 70. Thus, when the blast tube 20 is disposed over these elements, the second gas pathway GP2 is established between the exterior 71E of the blast baffle 70 and the interior of the blast tube sidewall 20S. That second gas pathway GP2 leads directly to the ramped surface 67 which directs the gas into the helical grooves 65G of the blast module 60. From there, the gas pathway proceeds over the respective flat exterior regions of the baffle module 60 and into subsequent helical and flat regions of additional baffle modules, all while traveling along the second gas pathway GP2, all while between the exterior surfaces of the blast baffle and baffle modules, generally between the baffle modules and the interior surface of the sidewall 20S of the baffle tube 20.

The baffle stack 50BS, as mentioned above, also can include a blast baffle 70. This blast baffle 70, shown in FIGS. 3 and 7-9, can be joined with the next adjacent baffle module, which can be a baffle module like that of the baffle module 60, or some modification of the baffle modules 51 and 52. Generally, the blast baffle 70 defines a blast baffle bullet opening 70O, as well as a bullet entry opening 70EO at the rearward portion of the blast baffle 70. The blast baffle bullet opening 70O and bullet entry opening 70EO can be generally aligned with and concentric with the bullet pathway BP and/or the longitudinal axis LA.

The blast baffle 70 can include a base 71 that transitions to an inner core 72. The inner core can be joined with a support ring 73 having a support seat 73S. The inner core can be joined with the support ring via one or more webs 73W. The base 71 optionally can be of a cylindrical shape and can include an interior connector interface 71IC, which can be threaded. In this manner, the blast baffle can be threadably joined with the exterior connector interface 61EC of the next adjacent baffle module 60. The base can include an exterior 71E that is substantially featureless, and can form a flat region that aligns in parallel to the bullet path or longitudinal axis. The base 71 can transition to the inner core 72 along a ramped or angled portion 71A, which also can be referred to as a transition portion or region. This ramped portion 71A can flare outward, away from the bullet pathway or longitudinal axis as it extends forward the bullet exit end 22 of the suppressor 10. Although shown as a frustoconical shape, the surface can include one or more grooves, recesses, scallops, or pathways that facilitate and/or impair travel of gas along a second gas pathway GP2, which extends generally through the secondary ports 73P, beyond the webs 73W, past the inner core 72, up and over the ramp portion 71A, over the exterior 71E, over the ramped surface 67 and into the helical grooves 65G defined between the respective baffle modules and the interior surface of the sidewall 20S of the elongate baffle tube 20.

The blast baffle, as mentioned above and shown in FIGS. 8 and 9, can include an inner core 72 that is joined with and optionally integral with the ramped portion 71A. The inner core can be suspended from the ring by one or more webs and extends forward from the ring toward the bullet exit end of the baffle tube. This inner core 72 defines the bullet opening 70O and an adjacent internal bore 70B. This internal bore 70B can be of a lesser dimension than the internal bore 71B of the base 71, which itself can be considered an extension or a portion of the inner core. Optionally, the inner core 72 can be considered to include a first portion that defines a first blast baffle bore 70B. The first portion 72 can transition at a transition region, which can coincide with the ramped portion 71A, to the second portion, which can coincide with the base 71, that defines a second blast baffle bore 71B. Depending on the application, the second blast baffle bore can be of larger internal and external dimension/diameter than the first blast baffle bore.

At the rearward portion of the inner core 72, the area adjacent the opening 70EO can include a rearward surface 72R that is configured to direct gases along the second gas pathway GP2, up over the exterior of the inner core 72 and so on. The rearward surface can include a ramped, tapered and/or curved contour to split gases off from the first gas pathway GP1. The inner core can be joined with one or more webs 73W that extend radially outwardly from the longitudinal axis LA. These webs can be connected at their outermost edges or parts with the support ring 73. Between the support webs 73W and optionally between the inner core and ring, one or more secondary ports 73P are defined. The secondary ports can be offset radially from the bullet opening 70O and the bullet entry opening 70EO of the blast baffle 70. It is through the secondary ports 73P that the propellant gas, as described below, enters and travels along the second gas pathway GP2. However, it is through the opening 70O, and in particular the bullet entry opening 70EO of the inner core, where the gases from the expansion chamber tube 80 enter the interior of the blast baffle to travel along the first gas pathway GP1 to be expelled into the subsequent baffle modules in the baffle stack 50BS.

Figure 8:
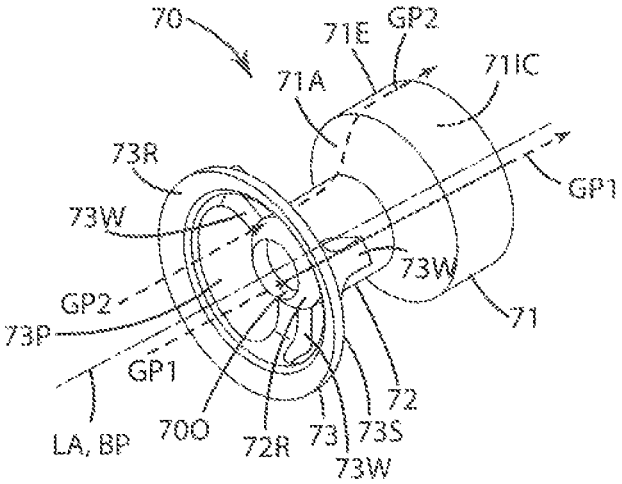
FIG. 8 is a perspective view of the blast baffle.
Figure 9:
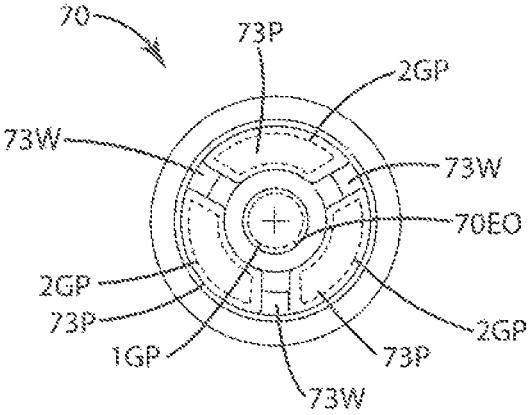
FIG. 9 is a bullet entry side, rear view of the blast baffle.
Figure 10:
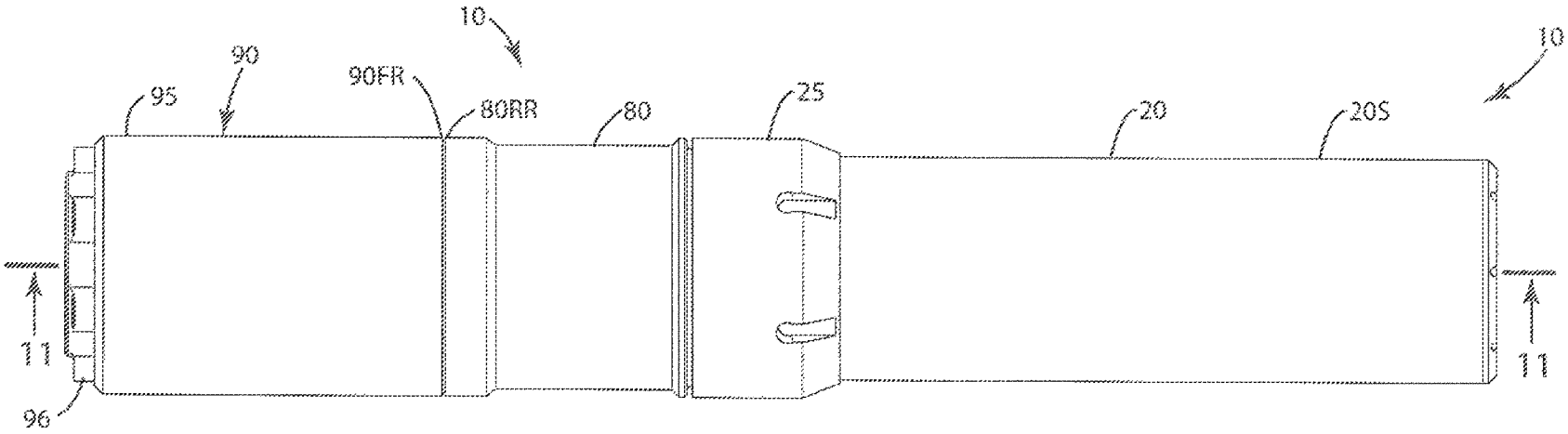
FIG. 10 is a right side view of the suppressor including an over the barrel expansion chamber, the left side view being a mirror image thereof.

Although shown as including three support webs 73W in FIG. 8, any number of webs can be used in this blast baffle 70 to support the ring. The support ring, as mentioned above, can include a support seat 73S. This seat 73S can be the side of the ring or flange that faces toward the forward or bullet exit end 22 of the baffle tube 20. The seat can include a tapered, curved and/or ramped surface. The seat 73S can be configured to directly engage the support rim 23, and in particular, the lip 23L thereof. In this manner, the blast baffle can be seated, via the support ring engaged with the support rim 23. Optionally, the seat 73S can be annually disposed around the entire ring.

As shown in FIG. 3, the seat 73S and lip 23L can be of mirror shapes so that one fits within and/or nests directly in the other in a sealing manner. Indeed, these shapes can assist in concentrically aligning the bullet path BP and longitudinal axis LA centrally within the baffle tube 20. These features, as well as those at the bullet exit end 22 also can assist in supporting the components of the baffle stack 50BS in concentricity with the tube and one another. For example, when the entire baffle stack 50BS is assembled in the baffle tube 20, with the respective forward end cap 40, baffle modules 51, 52 and 60, and blast baffle 70 being disposed in the interior 201 of the tube, the entire stack 50BS and its components can be supported from both the bullet entry end 21 and from the bullet exit end 22. In particular, after blast baffle and designated number of baffle modules and end cap are threadably coupled and tightened relative to one another, the forward end cap 40 and/or an forward end cap insert 30 can be tightened. This tightening draws the baffle stack 50BS generally toward the bullet exit opening 22 of the tube 20. In turn, this pulls the seat 73S against the support rim 23, in particular, the lip 23L. As the forward end cap 40 is further tightened relative to the bullet exit end 22 of the baffle tube 20, a compression force CF is borne by or exerted on the elongate baffle tube 20, while a corresponding tension force TF is borne by or exerted on the forward end cap, baffle modules and the blast baffle so as to further forcibly and sealingly engage the support seat of the blast baffle against the support rim of the baffle tube. In turn, the end cap, baffle modules and the blast baffle are supported at both the bullet entry end and the bullet exit end of the elongate baffle tube. This provides a secure mounting of these structures, and can ensure proper alignment of the respective bullet openings of each of the components with the bullet pathway BP, which in turn can reduce the likelihood of a bullet misaligned with the openings, which can potentially collide with the components and damage them.

The different and distinct gas pathways provided by the suppressor 10 of the current embodiment now will be described in further detail. To begin, it will be understood that upon firing the firearm to which the suppressor 10 is joined, a bullet exits the muzzle of the firearm, and thus enters the suppressor at speeds typically above 900 feet per second (fps) and generally lower than 4000 fps. The propellant gases that push the bullet, however, are expanding and can achieve much higher speeds. These propellant gases, which are rapidly expanding, are managed by the suppressor 10. In particular, the blast baffle 70 and suppressor 10 of the current embodiment, dissipate the expanding propellant gases, redirecting them to travel along two distinct gas pathways. For example, referring to FIGS. 3 and 7-9, the blast baffle 70 can separate propellant gases expanding from and diffusing from the expansion chamber tube 80 into a first gas pathway GP1 and a second gas pathway GP2. In particular, when the propellant gases under pressure, exit the expansion chamber tube 80 and enter the blast baffle 70, a significant portion of these propellant gases are expelled along the bullet pathway BP and generally along the longitudinal axis LA. These gases generally impinge the blast baffle and are diffused by the blast baffle into the first gas pathway GP1 coinciding with the bullet pathway BP. This first gas pathway extends and projects into the entry opening 70EO and opening 70O of the blast baffle 70. The gases then traverse into the inner core, inside the bore 70B and expand outward into the next adjacent bore 71B within the blast baffle 70. A portion of those gases along that first gas pathway continue along the bullet pathway and enter the opening 61EO of the next baffle module 60. Those gases then continue along the bullet pathway BP and enter the bullet entry openings, for example 50EO, 40EO and 30EO of subsequent baffle modules and end caps and end inserts.

Generally, the blast baffle inner core bore 70B and the inner core bullet entry opening 70EO are in fluid communication with a first gas pathway GP1. When gas traveling and expanding along the first gas pathway GP1 enters the baffle module 60, because the flange 52R of the next adjacent baffle module 52 surrounds the bullet entry opening 52EO of that baffle module, some of the gases are dissipated outward away from longitudinal axis, radially outward and over the steps, ridges and/or taper of the flange 52R and into the interior of the bore 65B. There, they collide with the internal surfaces of the base of that module and swirl around between the front portion of the flange and the rearward wall 52RW of the base of the next forward baffle module 52. Because of these multiple various collisions with the surfaces in the baffle modules, there are more opportunities for the propellant gases to be diverted, delayed, cooled, or otherwise impeded before further travel through the suppressor. The gases also continue to extend and travel along the first gas pathway GP1, entering each respective baffle module and colliding with the stepped cones or ridged or tapered flanges of each subsequent baffle module until eventually a small portion escapes out the bullet opening 30O of the forward end cap insert 30.

Separate and distinct from the first gas pathway GP1, gases also travel along a second gas pathway GP2. Initially, when the gases escape the expansion chamber tube 80, they encounter the blast baffle 70 first, within the interior 201 of the baffle tube 20. In particular, the propellant gases diffuse around the webs 73W of the blast baffle 70 and are channeled via the angled or curved, inwardly flared rear surface 73R of the ring 73 into the secondary ports 73P. The gases that extend and pass through the secondary ports 73P are those that embark upon the second gas pathway GP2. In particular, the gases expanding along this second gas pathway GP2 pass through the secondary ports 73P, around the webs 73W, over the exterior of the inner core 72, up and over the ramped surface 71A and over the exterior 71G of the base 71. From there, the gases traveling along this second gas pathway extend over the exteriors of the adjacent baffle modules.

For example as shown in FIG. 7, the gases along the gas pathway GP2 extend up over the ramped surface 67, into the grooves 65G, being directed in the helical path of the baffle module 60, and thus swirling helically around the baffle module in the grooves 65G until exiting the helical grooves and traversing across the generally flat or cylindrical exterior 61E of the module 60. On or along this portion of the baffle module, the gases travel generally linearly toward the next set of helical grooves of the next baffle module and so on, as described above. Optionally, while travelling on the second gas pathway GP2, the gases travel over the exterior surfaces of the respective blast baffle and baffle modules, but generally between those exterior surfaces and the interior surface of the sidewall 20S of the baffle tube 20. Generally, the blast baffle and its secondary ports are in fluid communication with a second gas pathway GP2 that is defined between the inner sidewall and the outer wall of the baffle module.

The various structures of the baffle stack 50BS, for example the blast baffle, baffle modules, and end insert and the like can be cast, molded, machined, or manufactured into one or more monolithic units. Optionally, the different components, such as the blast baffle, baffle modules, forward end cap, rearward end cap and/or end cap insert can be cast, molded, machined or manufactured as combined or integral single piece units, each unit having two or more components joined with one another permanently, rather than via a threaded connector interface as shown in the current embodiments.

Figure 11:
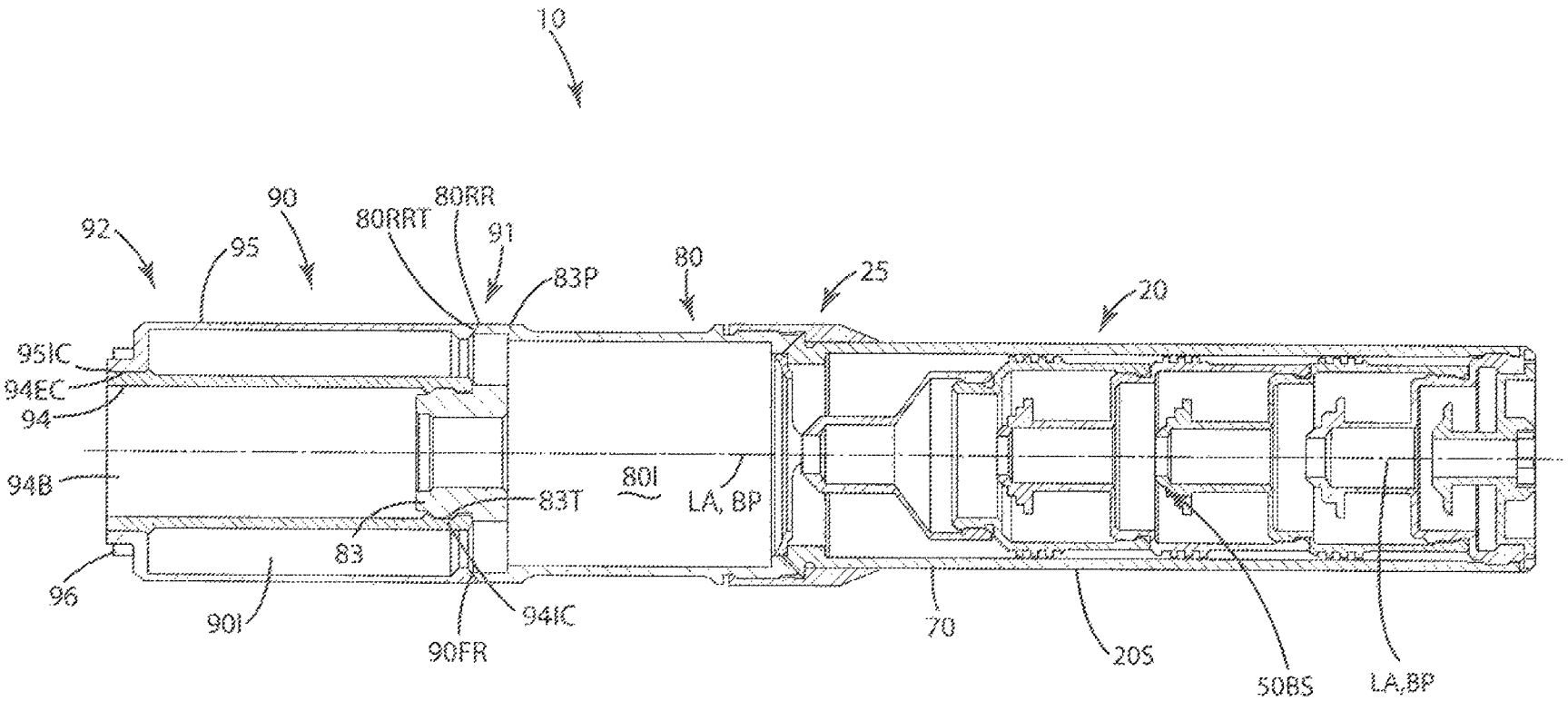
FIG. 11 is a section view of the suppressor taken along line 11-11 of FIG. 10.
Figure 12:
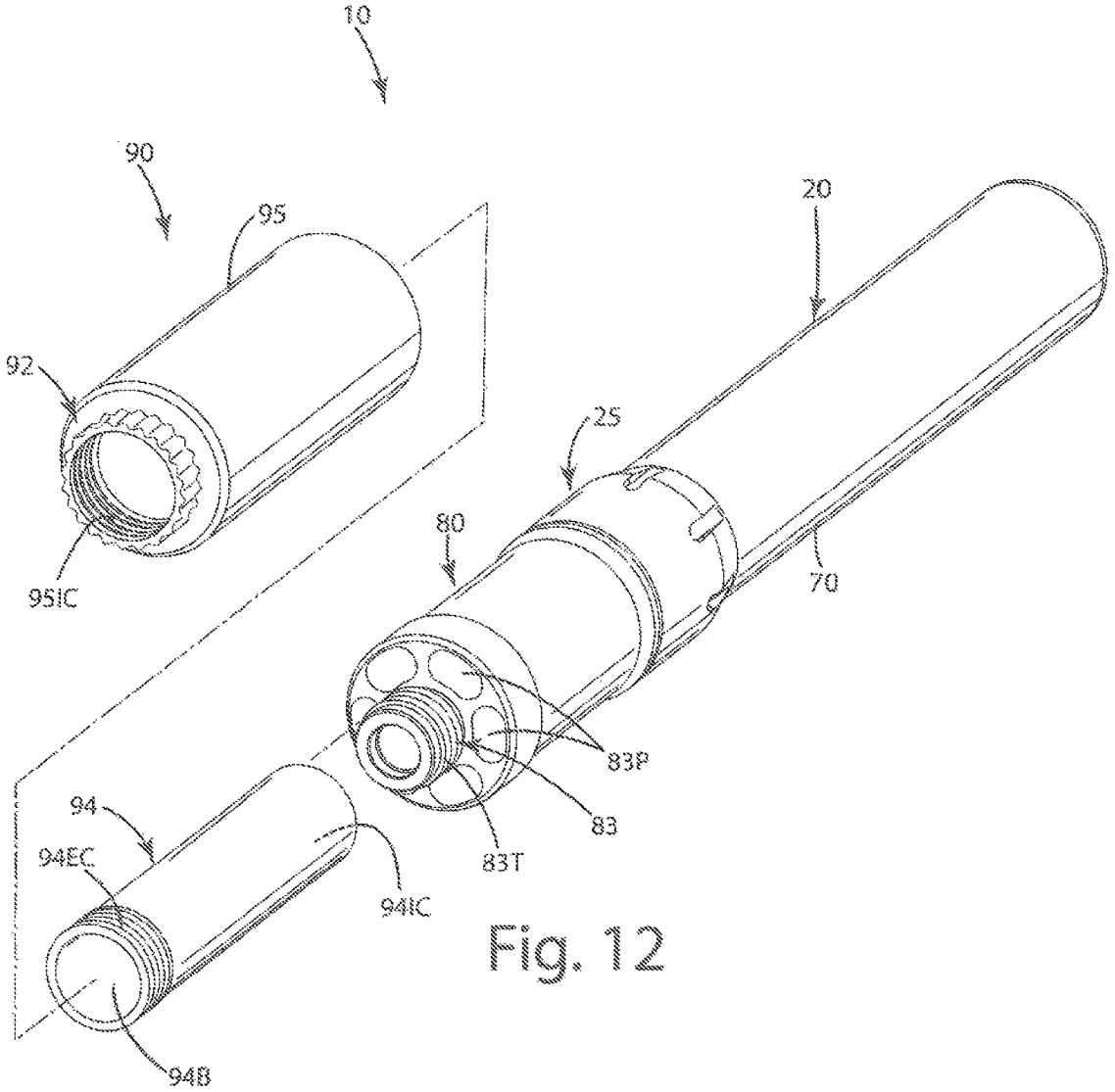
FIG. 12 is a rear exploded view of the over the barrel expansion chamber relative to the expansion chamber and baffle tube of the suppressor.

As mentioned above, the suppressor 10 of the current embodiments can be configured to join with and/or include an optional over the barrel expansion tube or chamber 90. Referring to FIGS. 11-12, the tube 90 is configured to extend rearward from the expansion chamber tube 80 and/or blast tube 20, over a portion of the barrel of the firearm to which the suppressor 10 is joined. With this over the barrel expansion tube 90, the expansion chamber, and total volume of the suppressor for dissipating, and capturing expanding propellant gases can be increased, without extending the length of the suppressor beyond the end of the muzzle. This can be helpful where the suppressor is to be used on firearms in tight spaces or within building structures.

The suppressor 10 can include the baffle tube 20, expansion chamber tube 80, the respective compression nut 25 and the other components described above, for example, the baffle modules 51, 52, 60, blast baffle 70, forward end cap 40 and forward end cap insert 30. The suppressor 10 however does not include the rear end cap 86 joined with the exterior of the muzzle interface 83, or the expansion tube 80 in general.

As shown in FIG. 11, the muzzle interface 83 is still configured to be joined with a muzzle of the firearm. Instead of the rearward end cap 86, the over the barrel expansion chamber or tube 90 is joined with the rearward portion of the expansion chamber. It will be noted here that the end 86 can be rapidly and easily removed manually or with a special tool and replaced with the over the barrel expansion tube 90, without destroying or otherwise substantially disassembling the suppressor 10. This can provide modularity to the suppressor and can enable it to be used on a variety of different weapon systems. Further, with the system, a user can selectively utilize the suppressor with or without the over the barrel expansion chamber. For example, the over the barrel expansion tube 90 is removably coupled to the expansion chamber tube so that the over the barrel expansion tube can be replaced with a rearward end cap to close the expansion chamber tube with the over the barrel expansion tube no longer associated with the suppressor 10.

As shown in FIGS. 11 and 12, the over the barrel expansion tube 90 can be joined with the expansion chamber tube 80. The over the barrel expansion tube 90 can include a forward end 91 and a rearward end 92. The forward end 91 can be joined with the expansion chamber tube 80, and the rearward end 92 can be closed off with a portion of the tube as described below. The over the barrel expansion tube 90 can include an inner tube 94 configured for placement adjacent the barrel and an outer tube 95 disposed outward and around the inner tube. The over the barrel expansion tube can extend rearward from a muzzle of the firearm over its barrel B a preselected distance while the elongate baffle tube is configured to extend forward of the muzzle. The over the barrel expansion tube 90 can define an internal expansion chamber 901. This over the barrel chamber 901 can be in fluid communication with the expansion chamber 80, and in particular, its internal chamber 801 via one or more ports 83P defined around and/or by the muzzle interface 83. The inner and outer tubes can be separate parts, threadably joined with one another as shown, or alternatively, the tubes can be integrally formed so that the over the barrel expansion chamber tube 90 is an integral single piece unit. As shown, however, the outer tube 95 can define an interior connector interface 95IC adjacent the second end or rearward end 92 of the over the barrel expansion tube. The inner tube 94 can include an exterior connector interface 94EC. These interfaces can be threaded so that the outer tube can be further coupled to the inner tube. These tubes are configured so that they are individually or both removable and replaceable relative to the expansion tube 80 and/or other parts of the baffle tube 20.

The inner tube 94 can define an interior bore 94B or cavity that extends to the muzzle interface 83 of the expansion chamber 80. The interior bore 94B can be sized so that fits over a barrel of a preselected size or sizes. Optionally, the inner tube can come in a variety of sizes configured to be joined with the outer tube 95. These sizes can be dimensioned with diameters that closely fit over barrels of a variety of different sizes. With this construction of the over the barrel expansion tube 90, a user can modify the size of the internal expansion chamber 901 by the changing the size of the inner tube 94. The user also can appropriately size the inner tube relative to the barrel of the weapon to which the suppressor 10 will be attached.

The inner tube 94, as shown in FIG. 11 also can be configured to include an interior connector interface 94IC. This interior connector interface can join the muzzle interface 83 of the expansion tube 80. In particular, the interior connector interface 94IC can be threaded so that it will thread onto the exterior threads 83T of the muzzle interface 83, thereby threadably coupling these items. Optionally, the muzzle interface 83 of the expansion chamber tube 80 can extend rearward beyond the rear rim 80RR of the expansion tube 80. This can enable or provide a stub onto which the over the barrel expansion chamber tube 90 can be joined.

As shown in FIG. 11, and as mentioned above, the rearward rim 80RR of the expansion tube 80 can include a rearward rim having a tapered flange that generally flares inward. The outer tube 95 can include a corresponding tapered flange at the forward rim or edge 90F. These tapered flanges, that is, the rearward taper 80RRT and forward taper 90FR can engage one another when the over the barrel expansion tube 90 is joined with the expansion tube 80. Due to the tapers of the respective tapered flanges, these components can sealingly engage one another and can seal the suppressor at the joint between the over the barrel expansion chamber tube 90 and the expansion chamber tube 80 to prevent gases from being expelled at that joint. Due to the tapered flanges at this joint, the over the barrel expansion chambers also can be brought into concentrating with the expansion chamber tube 80 and the suppressor in general. The sealing action at the joint or interface of the inner tube and the expansion chamber tube, can be enhanced by engaging an engagement portion 96 of the over the barrel expansion chamber tube 90 with a tool or manually, and tightening the tube 90 so that the inner tube threads onto the muzzle interface 83 and forcibly pushes the outer tube 95 along, so that the outer tube forward rim 90F engages the rearward rim 80RR, that is the tapered flanges engage one another and can seal the corresponding joint under that tightening force. Optionally, the over the barrel expansion tube 90 can be configured to include a threaded portion that threads to a corresponding threaded portion associated with the expansion tube 80 at a first location. Distal, and radially outward from the first location, the tube 90 can include a tapered flange that seats against a corresponding tapered flange of the expansion tube 80. Upon tightening of the threads, the tapered flanges engage and optionally seal against one another at a joint between the tube 90 and tube 80.

As mentioned above, when the over the barrel expansion chamber is installed, upon firing of a bullet, gases enter the internal chamber AI of the expansion chamber tube 80. Some of those gases go forward and into the blast baffle 70 to be dissipated among the various components inside the baffle tube 20. Some of those gases, however, expand rearwardly over into the internal chamber 901 of the over the barrel expansion tube 90, and expand generally rearward over the barrel of the firearm which the suppressor 10 is joined. With this increased volume effective volume of the expansion chamber plus the over the barrel expansion chamber, propellant gases can be dissipated substantially.

The over the barrel expansion chamber tube 90 can be joined with the remainder of the suppressor, for example, the expansion chamber tube 80 via an internal threaded coupling, associated with the inner tube 94 and the muzzle interface 83. The exterior portion of the tube 90, for example, the outer tube 95 can be coupled to the expansion tube 80 via a sealed joint between flanges, where surfaces of the tube 90 engage surfaces of the tube 80 under forces generated by tightening the threaded coupling at the muzzle interface. Thus, tightening of one of the inner tube or outer tube can engage the other against a part of the expansion tube 80 to seal the elements together. Of course, in some applications, the over the barrel expansion chamber tube 90 can include threads at the forward rim 90FR that interface with additional threads disposed on the rearward rim 80RR of the expansion tube to join these features. Further optionally, the inner tube can interface with the muzzle interface at respective sealing flanges, rather than threaded portions. A variety of other coupling configurations are contemplated to removably join the over the barrel expansion chamber tube 90 with the remainder of the suppressor 10 and its components.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A suppressor for a firearm, comprising:

an elongate baffle tube having a bullet entry end, an opposing bullet exit end and a longitudinal axis, the elongate baffle tube having a bullet pathway extending longitudinally therethrough from the bullet entry end to the bullet exit end, the bullet entry end including a support rim;

a forward end cap threadably joined with the elongate baffle tube adjacent the bullet exit end, the forward end cap defining an end cap bullet opening aligned with the bullet pathway and including a threaded forward end cap outer connector interface;

a first baffle module including a threaded first baffle module inner connector interface threadably joined with the threaded forward end cap outer connector interface, the first baffle module defining an first baffle module bullet opening aligned with the bullet pathway, the first baffle module including a threaded first baffle outer connector interface;

a second baffle module including a threaded second baffle module inner connector interface threadably joined with the threaded first baffle outer connector interface, the second baffle module defining an second baffle module bullet opening aligned with the bullet pathway, the second baffle module including a threaded second baffle outer connector interface;

a blast baffle joined with the second baffle module, the blast baffle defining a blast baffle bullet opening aligned with the bullet pathway, the blast baffle including support seat; and an expansion chamber tube coupled to the elongate baffle tube;

wherein the forward end cap is sufficiently tightened relative to the bullet exit end of the elongate baffle tube so that a compression force is borne by the elongate baffle tube and a corresponding tension force is borne by the first baffle module, the second baffle module and the blast baffle so as to engage the support seat of the blast baffle against the support rim of the baffle tube, wherein the bullet entry end of the elongate baffle tube includes an elongate baffle tube tapered flange adjacent the support rim, wherein the expansion chamber tube includes an expansion chamber tube tapered flange corresponding to the elongate baffle tube tapered flange, wherein the expansion chamber tube tapered flange sealingly engages the elongate baffle tube tapered flange, whereby the forward end cap, the first baffle module, the second baffle module, and the blast baffle are supported at both the bullet entry end and the bullet exit end of the elongate baffle tube.

2. The suppressor of claim 1, comprising:

a compression nut threadably engaged with at least one of the elongate baffle tube and the expansion chamber tube to force the expansion chamber tube tapered flange into sealing engagement with the elongate baffle tube tapered flange; and a third baffle module including a threaded third baffle module inner connector interface threadably joined with the threaded third baffle outer connector interface, the third baffle module joining the second baffle module with the blast baffle.

3. A suppressor for a firearm, comprising:

an elongate baffle tube having a bullet entry end, an opposing bullet exit end and a longitudinal axis, the elongate baffle tube having a bullet pathway extending longitudinally therethrough from the bullet entry end to the bullet exit end, the bullet entry end including a support rim;

a forward end cap threadably joined with the elongate baffle tube adjacent the bullet exit end, the forward end cap defining an end cap bullet opening aligned with the bullet pathway and including a threaded forward end cap outer connector interface;

a first baffle module including a threaded first baffle module inner connector interface threadably joined with the threaded forward end cap outer connector interface, the first baffle module defining an first baffle module bullet opening aligned with the bullet pathway, the first baffle module including a threaded first baffle outer connector interface;

a second baffle module including a threaded second baffle module inner connector interface threadably joined with the threaded first baffle outer connector interface, the second baffle module defining an second baffle module bullet opening aligned with the bullet pathway, the second baffle module including a threaded second baffle outer connector interface;

a blast baffle joined with the second baffle module, the blast baffle defining a blast baffle bullet opening aligned with the bullet pathway, the blast baffle including support seat, wherein the forward end cap is sufficiently tightened relative to the bullet exit end of the elongate baffle tube so that a compression force is borne by the elongate baffle tube and a corresponding tension force is borne by the first baffle module, the second baffle module and the blast baffle so as to engage the support seat of the blast baffle against the support rim of the baffle tube, whereby the forward end cap, the first baffle module, the second baffle module, and the blast baffle are supported at both the bullet entry end and the bullet exit end of the elongate baffle tube, wherein the elongate baffle tube includes an inner sidewall, wherein the first baffle module includes an outer wall distal from the first baffle module bullet opening, wherein a helical gas pathway is defined between the inner sidewall and the outer wall of the first baffle module to impede gas flow toward the bullet exit end.

4. A suppressor for a firearm, comprising:

an elongate baffle tube having a bullet entry end, an opposing bullet exit end and a longitudinal axis, the elongate baffle tube having a bullet pathway extending longitudinally therethrough from the bullet entry end to the bullet exit end, the bullet entry end including a support rim;

a forward end cap joined with the elongate baffle tube adjacent the bullet exit end, the forward end cap defining an end cap bullet opening aligned with the bullet pathway;

a first baffle module joined with the forward end cap, the first baffle module defining an first baffle module bullet opening aligned with the bullet pathway;

a second baffle module joined with the first baffle module, the second baffle module defining an second baffle module bullet opening aligned with the bullet pathway;

a blast baffle joined with the second baffle module, the blast baffle defining a blast baffle bullet opening aligned with the bullet pathway, the blast baffle including support seat, an expansion chamber tube coupled to the elongate baffle tube;

wherein the forward end cap is joined relative to the bullet exit end of the elongate baffle tube so that a compression force is borne by the elongate baffle tube and a corresponding tension force is borne by the first baffle module, the second baffle module and the blast baffle so as to forcibly engage the support seat of the blast baffle against the support rim of the baffle tube, wherein the bullet entry end of the elongate baffle tube includes an elongate baffle tube tapered flange adjacent the support rim, wherein the expansion chamber tube includes an expansion chamber tube tapered flange corresponding to the elongate baffle tube tapered flange, wherein the expansion chamber tube tapered flange sealingly engages the elongate baffle tube tapered flange, whereby the forward end cap, the first baffle module, the second baffle module, and the blast baffle are supported at both the bullet entry end and the bullet exit end of the elongate baffle tube.

5. The suppressor of claim 4 comprising:

an expansion chamber tube removably coupled to the elongate baffle tube adjacent the bullet entry end of the elongate baffle tube, the expansion chamber tube including an expansion chamber tube flange corresponding to an elongate baffle tube flange, wherein the expansion chamber tube flange is forcibly engaged with the elongate baffle tube flange to provide a sealed joint between the expansion chamber tube and the elongate baffle tube.

6. The suppressor of claim 5 comprising:

a compression nut threadably engaged with at least one of the elongate baffle tube and the expansion chamber tube to force the expansion chamber tube flange into sealing engagement and concentricity with the elongate baffle tube flange.

7. A suppressor for a firearm, comprising:

an elongate baffle tube having a bullet entry end, an opposing bullet exit end and a longitudinal axis, the elongate baffle tube having a bullet pathway extending longitudinally therethrough from the bullet entry end to the bullet exit end, the bullet entry end including a support rim;

a forward end cap joined with the elongate baffle tube adjacent the bullet exit end, the forward end cap defining an end cap bullet opening aligned with the bullet pathway;

a first baffle module joined with the forward end cap, the first baffle module defining an first baffle module bullet opening aligned with the bullet pathway;

a second baffle module joined with the first baffle module, the second baffle module defining an second baffle module bullet opening aligned with the bullet pathway;

a blast baffle joined with the second baffle module, the blast baffle defining a blast baffle bullet opening aligned with the bullet pathway, the blast baffle including support seat, wherein the forward end cap is joined relative to the bullet exit end of the elongate baffle tube so that a compression force is borne by the elongate baffle tube and a corresponding tension force is borne by the first baffle module, the second baffle module and the blast baffle so as to forcibly engage the support seat of the blast baffle against the support rim of the baffle tube, whereby the forward end cap, the first baffle module, the second baffle module, and the blast baffle are supported at both the bullet entry end and the bullet exit end of the elongate baffle tube;

an expansion chamber tube removably coupled to the elongate baffle tube adjacent the bullet entry end of the elongate baffle tube, the expansion chamber tube including an expansion chamber tube flange corresponding to an elongate baffle tube flange, wherein the expansion chamber tube flange is forcibly engaged with the elongate baffle tube flange to provide a sealed joint between the expansion chamber tube and the elongate baffle tube, a compression nut threadably engaged with at least one of the elongate baffle tube and the expansion chamber tube to force the expansion chamber tube flange into sealing engagement and concentricity with the elongate baffle tube flange, a plurality of baffle modules disposed in the elongate baffle tube, with no baffle disposed in the expansion chamber tube, wherein the elongate baffle tube flange is tapered to flare outward as the elongate baffle tube tapered flange extends toward the bullet exit end.

8. A suppressor for a firearm, comprising:

an elongate baffle tube having a bullet entry end, an opposing bullet exit end and a longitudinal axis, the elongate baffle tube having a bullet pathway extending longitudinally therethrough from the bullet entry end to the bullet exit end, the bullet entry end including a support rim;

a forward end cap joined with the elongate baffle tube adjacent the bullet exit end, the forward end cap defining an end cap bullet opening aligned with the bullet pathway;

a first baffle module joined with the forward end cap, the first baffle module defining an first baffle module bullet opening aligned with the bullet pathway;

a second baffle module joined with the first baffle module, the second baffle module defining an second baffle module bullet opening aligned with the bullet pathway;

a blast baffle joined with the second baffle module, the blast baffle defining a blast baffle bullet opening aligned with the bullet pathway, the blast baffle including support seat, wherein the forward end cap is joined relative to the bullet exit end of the elongate baffle tube so that a compression force is borne by the elongate baffle tube and a corresponding tension force is borne by the first baffle module, the second baffle module and the blast baffle so as to forcibly engage the support seat of the blast baffle against the support rim of the baffle tube, whereby the forward end cap, the first baffle module, the second baffle module, and the blast baffle are supported at both the bullet entry end and the bullet exit end of the elongate baffle tube;

wherein the first baffle module includes an exterior and an interior, the exterior including a threaded exterior connector interface, the interior including a threaded interior connector interface, the first baffle module defining an baffle module bullet opening aligned with the bullet pathway, the first baffle module including a first baffle module portion that defines a first baffle module bore, the first portion transitioning to a second baffle module portion that defines a second baffle module bore, the second baffle module bore of a larger internal dimension than the first baffle module bore, wherein a gas pathway is defined between the second baffle module portion and the inner wall of the elongate baffle tube.

9. The suppressor of claim 8, wherein the first baffle module portion includes a bullet entry opening, wherein a stepped cone is disposed adjacent and surrounding the bullet entry opening on the exterior, wherein the second baffle module bore includes an internal dimension that is greater than an outermost dimension of the stepped cone.

10. A suppressor for a firearm, comprising:

an elongate baffle tube having a bullet entry end, an opposing bullet exit end, the bullet entry end including a support rim;

a forward end cap joined with the elongate baffle tube adjacent the bullet exit end;

a first baffle module joined with the forward end cap;

a second baffle module joined with the first baffle;

a blast baffle joined with the second baffle module, the blast baffle including support seat; and an over the barrel expansion tube joined with the expansion chamber tube, the over the barrel expansion tube configured to be positioned over a barrel of a firearm to which the suppressor is attached, and configured to extend rearward from a muzzle of the firearm a preselected distance while the elongate baffle tube is configured to extend forward of the muzzle, wherein the forward end cap is forcibly joined relative to the bullet exit end of the elongate baffle tube so that a compression force is borne by the elongate baffle tube and a corresponding tension force is borne by the first baffle module, the second baffle module and the blast baffle so as to engage the support seat of the blast baffle against the support rim of the baffle tube, wherein the over the barrel expansion tube is removably coupled to the expansion chamber tube so that the over the barrel expansion tube can be replaced with a rearward end cap to close the expansion chamber tube, whereby a user can selectively utilize the suppressor with or without the over the barrel expansion chamber, whereby the forward end cap, the first baffle module, the second baffle module, and the blast baffle are supported at both the bullet entry end and the bullet exit end of the elongate baffle tube.

* * * * *